US005461980A

United States Patent [19]

Maejima et al.

[11] Patent Number: 5,461,980

[45] Date of Patent: Oct. 31, 1995

[54] PLATE MOUNTING APPARATUS FOR PRINTING PRESS

[75] Inventors: Kazuhiro Maejima; Toshiharu Takemata, both of Ibaragi, Japan

[73] Assignee: Komori Corporation, Tokyo, Japan

[21] Appl. No.: 231,983

[22] Filed: Apr. 21, 1994

Related U.S. Application Data

[63] Continuation of Ser. No. 96,924, Jul. 23, 1993, abandoned.

[30] Foreign Application Priority Data

Jul. 31, 1992 [JP] Japan ..... 4-059158 U

[51] Int. Cl.[6] ..... B41F 1/28

[52] U.S. Cl. ..... 101/415.1; 200/56 R; 200/275; 200/308

[58] Field of Search ..... 101/415.1, 217, 101/415, 409, 410, 389, 1; 200/52 R, 56 R, 275, 308

[56] References Cited

U.S. PATENT DOCUMENTS

| | | | |
|---|---|---|---|
| 3,719,142 | 3/1973 | Abe | 101/415.1 |
| 3,839,958 | 10/1974 | Kent et al. | 101/415.1 |
| 4,437,407 | 3/1984 | Wirz et al. | 101/415.1 |
| 4,603,641 | 8/1986 | Jeschke et al. | 101/415.1 |
| 5,189,958 | 3/1993 | Tafel et al. | 101/415.1 |
| 5,208,960 | 5/1993 | Maejima et al. | 101/217 |
| 5,253,583 | 10/1993 | Yamamoto et al. | 101/409 |
| 5,293,820 | 3/1994 | Maejima et al. | 101/415.1 |
| 5,320,041 | 6/1994 | Maejima et al. | 101/415.1 |

FOREIGN PATENT DOCUMENTS

| | | |
|---|---|---|
| 0075900 | 9/1982 | European Pat. Off. . |
| 0195848 | 11/1985 | European Pat. Off. . |
| 0433798A3 | 12/1990 | European Pat. Off. . |
| 0551976A1 | 1/1993 | European Pat. Off. . |
| 0555782A1 | 8/1993 | European Pat. Off. . |
| 3325583A1 | 1/1985 | Germany . |
| 3638428C1 | 11/1986 | Germany . |
| 2166084A | 4/1986 | United Kingdom . |

*Primary Examiner*—Eugene H. Eickholt
*Attorney, Agent, or Firm*—Blakely, Sokoloff, Taylor & Zafman

[57] ABSTRACT

An apparatus for mounting a plate on a plate cylinder includes a plate lockup device, a reference pin, a detecting sensor, and a lamp. The plate lockup device is provided in a gap formed in a circumferential surface of the plate cylinder. The reference pin is supported by a gripper portion of the plate lockup device and engaged with a reference pin hole formed at an insertion end of a plate when the plate is inserted into the gripper portion of the plate lockup device. The detecting sensor is arranged at a position corresponding to at least a bottom portion of the reference pin hole to electrically detect that the bottom portion of the reference pin hole contacts the reference pin. The lamp confirms and indicates insertion of the plate on the basis of an output from the detecting sensor.

6 Claims, 5 Drawing Sheets

PLATE MOUNTING APPARATUS FOR PRINTING PRESS

This is a continuation of application Ser. No. 08/096,924 filed on Jul. 23, 1993 now abandoned.

BACKGROUND OF THE INVENTION

The present invention relates to a plate mounting apparatus for a printing press, which winds, on the circumferential surface of a plate cylinder, a plate having one end gripped by a leading-side plate lockup device provided in the gap formed in the outer circumferential surface of the plate cylinder, and causes a trailing-side plate lockup device in the gap in the outer circumferential surface of the plate cylinder to grip the other end of the plate, thereby mounting the plate on the plate cylinder.

In a general printing press, leading- and trailing-side plate lockup devices each including a plate lockup table and gripper plates pivotally supported by the plate lockup table are provided in a gap formed in the outer circumferential surface of a plate cylinder. The leading end of a plate is gripped by the leading-side plate lockup device by the opening and closing operations of the gripper plates, and wound on the circumferential surface of the plate cylinder by rotating the plate cylinder by almost one revolution, and thereafter the gripper plates are opened and closed so that the trailing-side plate lockup device grips the trailing end of the plate, thereby mounting the plate on the plate cylinder.

In a printing operation, an ink and water are supplied to the surface of the mounted plate to form an image, and the image is transferred to paper being transported directly or through a blanket cylinder, thereby printing the image.

In this printing operation, when the plate is distortedly mounted, the image is distortedly printed, degrading the quality of the printed matter. Especially, in multicolor printing, the different colors are misregistered to largely degrade the quality of the printed matter.

In order to resolve this problem, conventionally, pin holes are formed at the predetermined positions of the plate, or substantially cross-shaped register marks are drawn at the predetermined positions of the plate before a pattern is printed on the plate for plate making. The position of the pattern is determined with reference to these pin holes or register marks or the like, thereby performing print making. Then, with reference to the above-described pin holes, register marks, or the leading end of the plate, U-shaped reference pin holes open at the leading end of the plate are formed at the leading end portion of the plate by a known plate punching machine. Thereafter, the plate is mounted on the plate cylinder while engaging the reference pin holes formed in the plate with the reference pins provided on the plate gripper portion of the leading-side plate lockup device.

More specifically, when the plate lockup device is caused to grip the plate during plate mounting operation, the gripper plates of the leading-side plate lockup device are opened, and the leading-side end portion of the plate is inserted into the gripper portion between the gripper plates and the plate lockup table while engaging the reference pins of the plate with the reference pin holes of the plate lockup device. After the U-shaped bottom portion of the reference pin hole is brought into contact with the reference pin to position the plate, the gripper plates are closed, and the end portion of the plate is gripped by the plate lockup device.

In such a conventional plate mounting apparatus, however, the operator visually checks whether the U-shaped bottom portion of the reference pin hole contacts the reference pin. Although a skilled operator is required, variations caused by the degrees of skills of the operators are inevitable so that satisfactory positioning precision cannot always be obtained. Accordingly, work with a cramped posture in a narrow space overloads the operator.

SUMMARY OF THE INVENTION

It is an object of the present invention to provide a plate mounting apparatus for a printing press, capable of reliably mounting a plate on a plate cylinder.

It is another object of the present invention to provide a plate mounting apparatus for a printing press to improve printing quality.

In order to achieve the above objects of the present invention, there is provided an apparatus for mounting a plate on the plate cylinder, comprising a plate lockup device provided in a gap formed in a circumferential surface of the plate cylinder, a reference pin supported by a gripper portion of the plate lockup device and engaged with a reference pin hole formed at an insertion end of a plate when the plate is inserted into the gripper portion of the plate lockup device, plate detecting means arranged at a position corresponding to at least a bottom portion of the reference pin hole, for electrically detecting that the bottom portion of the reference pin hole contacts the reference pin, and indicator means for confirming and indicating insertion of the plate on the basis of an output from the plate detecting means.

DESCRIPTION OF THE PREFERRED EMBODIMENTS

Figure 1:
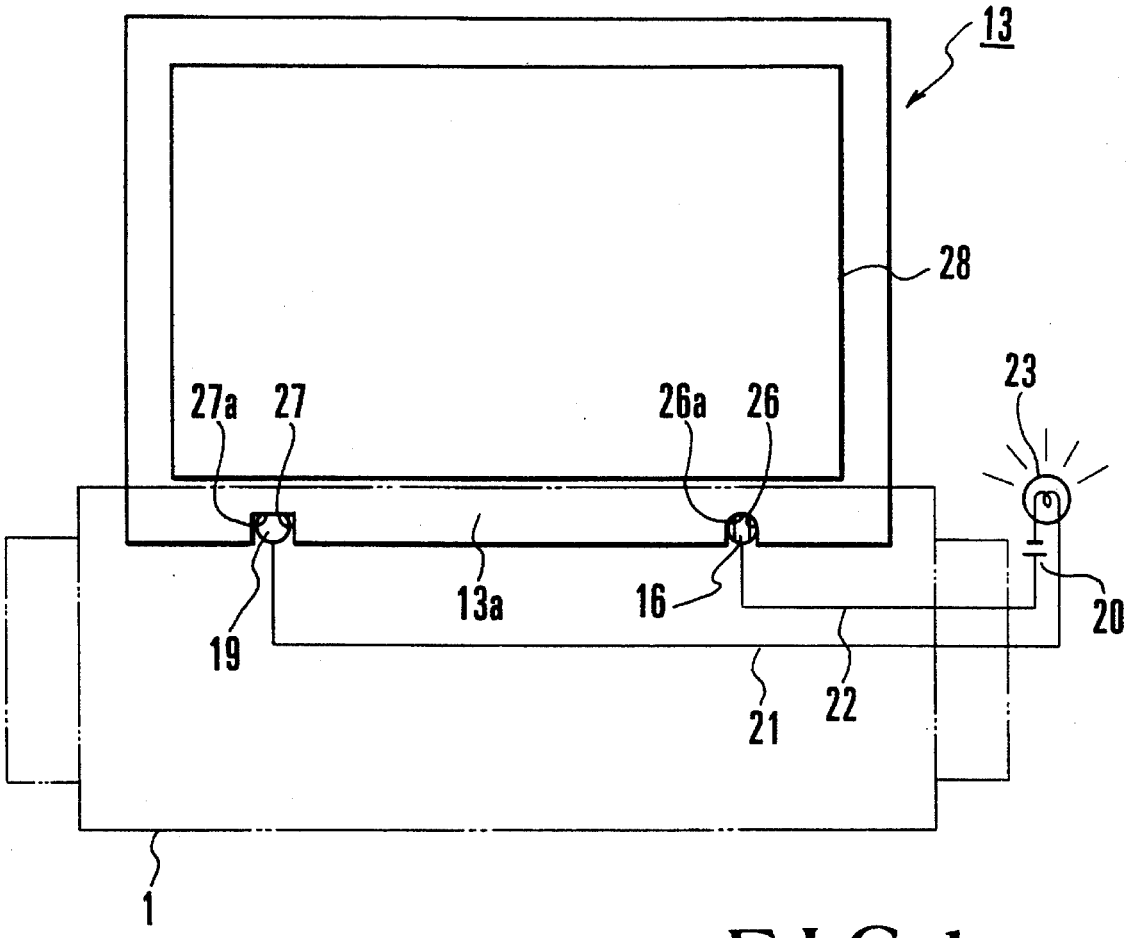
FIG. 1 is a schematic view showing the arrangement of a plate mounting apparatus for a printing press according to an embodiment of the present invention.
Figure 2:
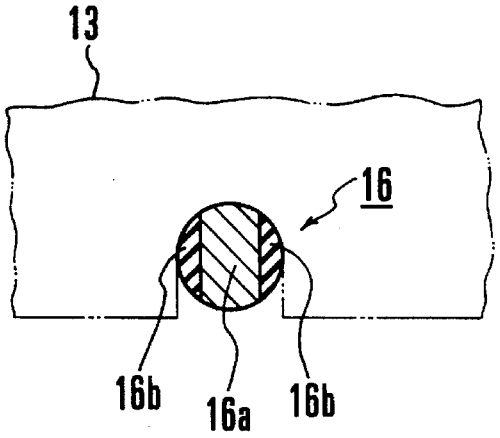
FIG. 2 is an enlarged sectional view of a reference pin shown in FIG. 1.
Figure 3:
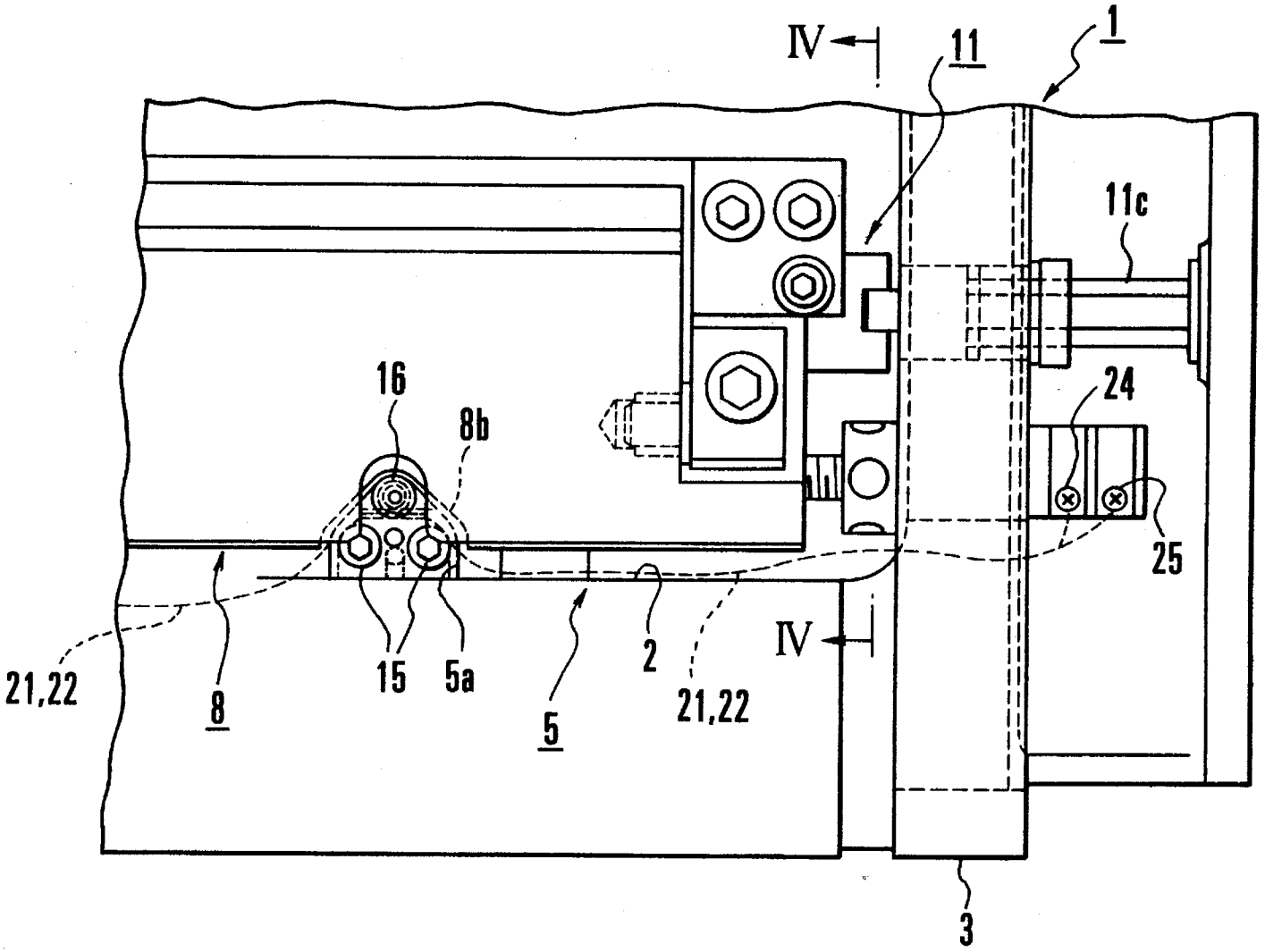
FIG. 3 is a plan view of an end portion of a plate cylinder shown in FIG. 1.
Figure 4:
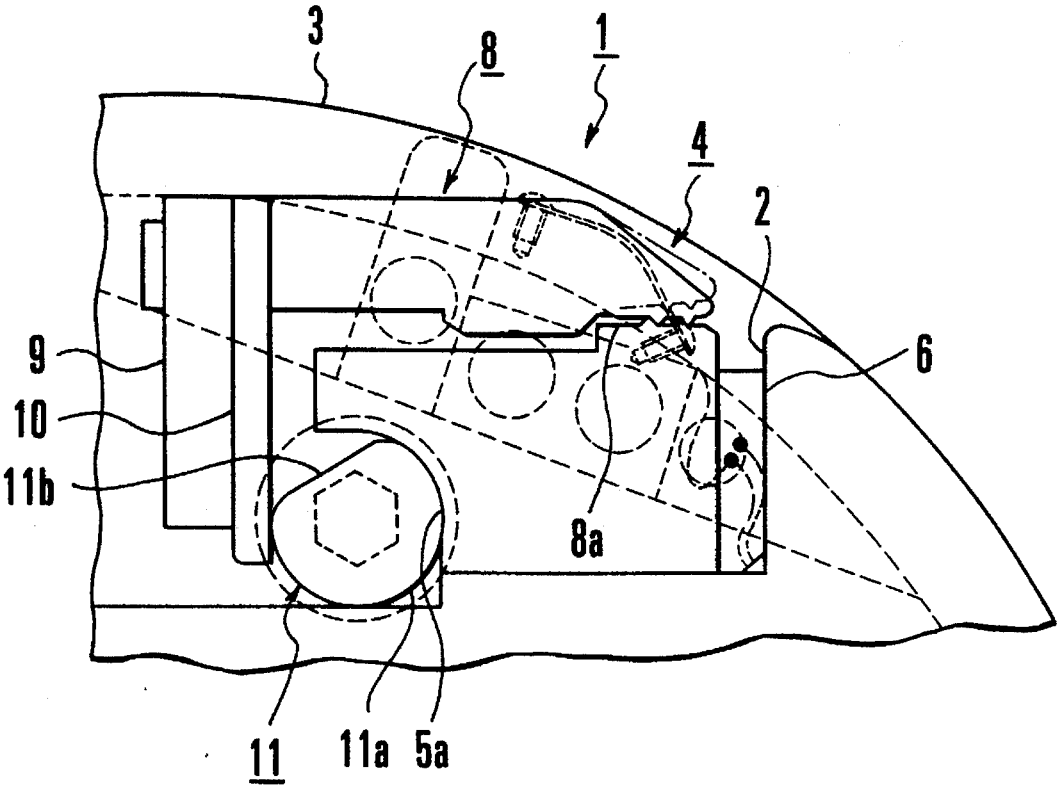
FIG. 4 is a sectional view taken along the line IV—IV of FIG. 2.
Figure 5:
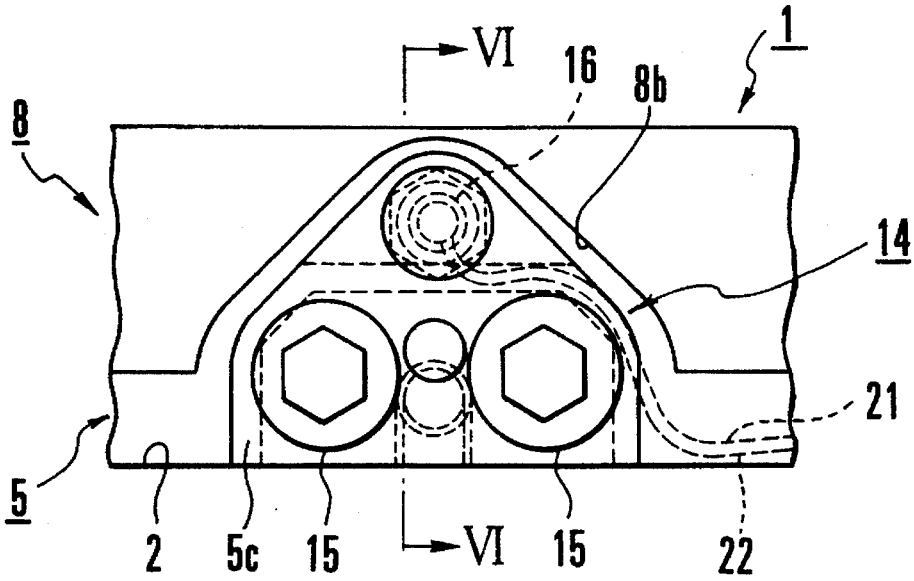
FIG. 5 is an enlarged plan view of a portion near the reference pin shown in FIG. 1.
Figure 6:
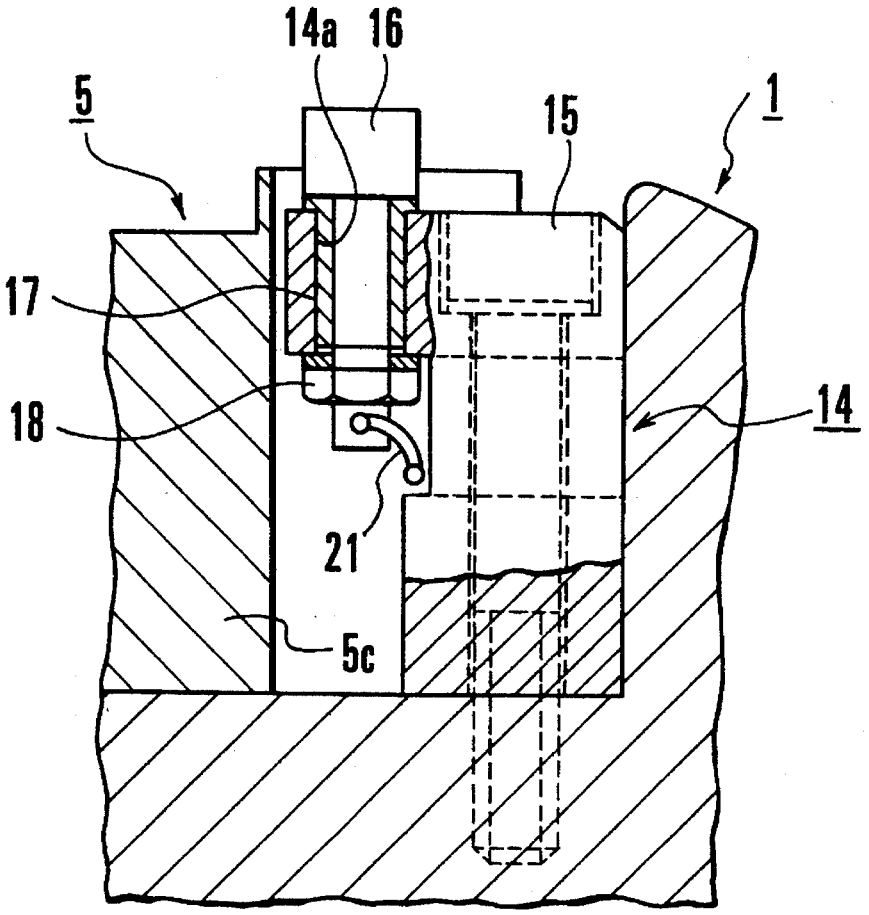
FIG. 6 is a sectional view taken along the line VI—VI of FIG. 5.

FIGS. 1 to 6 show a plate mounting apparatus for a printing press according to an embodiment of the present invention. FIG. 1 shows the schematic arrangement of the plate mounting apparatus, FIG. 2 shows a reference pin, FIG. 3 shows an end portion of a plate cylinder, FIG. 4 shows a section thereof along the line IV—IV of FIG. 3, FIG. 5 shows a portion near the reference pin, and FIG. 6 shows a section thereof along the line VI—VI of FIG. 5.

Referring to FIGS. 1 to 6, a gap 2 is formed in the outer circumferential surface of a plate cylinder 1 by substantially the entire length thereof, and two open ends of the gap 2 are closed with disk-like bearers 3. A leading-side plate lockup device 4 and a trailing-side plate lockup device (not shown) having almost the same structure as that of the leading-side plate lockup device 4 are disposed in the gap 2 to extend parallel to each other by almost the entire length of the gap 2.

Of the two plate lockup devices, the leading-side plate lockup device 4 has a plate lockup table 5 having a substantially rectangular section and extending in the axial direction of the gap 2 as shown in FIG. 4. The plate lockup table 5 is positioned by a gauge plate 6 and fixed on the bottom surface of the gap 2 by bolts (not shown).

A plurality of gripper plates 8 having substantially the same total length as that of the plate lockup table 5 and divided in the axial direction are swingably supported on the plate lockup table 5 by bolts (not shown). A cam shaft 11 having a plurality of cams each consisting of an arcuated portion 11*a* and a linear portion 11*b* is pivotally axially supported, between a plate 10 pressed by a press plate 9 to be fixed on the end faces of the gripper plates 8 and a recess hole 5*a* of the plate lockup table 5, by the two bearers 3 and an intermediate bearing (not shown).

A projecting portion 11*c* of the cam shaft 11 projecting from a bearer 3 and having an intermediate portion coupled through coupling has a hexagonal section, so that the projecting portion 11*c* can be engaged by a wrench to turn the cam shaft 11. The gripper plates 8 having gripper surfaces 8*a* are biased in the opening direction toward a gripper surface 5*b* of the plate lockup table 5 by the spring force of a spring member (not shown). The gripper plates 8 are swung by the cooperation of the pivoting operation of the cam shaft 11 and the spring force of the spring member, and the gripper surfaces 8*a* are opened away from the gripper surface 5*b*.

The plate mounting apparatus will be described. As shown in FIG. 1, a U-shaped reference pin hole 26 and a rectangular reference pin hole 27 are formed in the leading end of a plate 13 consisting of a conductive material such as aluminum to be spaced apart from each other by a predetermined distance. These reference pin holes 26 and 27 are formed at the leading-side end portions of the plate 13 by a press punching machine with reference to the above-described pin holes, register marks, or the leading end portion of the plate 13, after press making is performed by printing a pattern 28 with reference to the pin holes or cross-shaped register marks at the predetermined positions of the plate 13. The U-shaped reference pin hole 26 and the rectangular reference pin hole 27 are open at the leading end of the plate 13.

As shown in FIGS. 3 and 5, two pairs of triangular notches 5*c* and 8*b* are formed in the plate lockup table 5 and the corresponding gripper plates 8 at positions close to the end portions thereof in the longitudinal direction, so that the notches 5*c* and 8*b* correspond to the reference pin holes 26 and 27. As shown in the longitudinal sectional view of FIG. 6, a reference pin base 14, having a triangular shape when seen from above and an inverted L-shaped section, is housed in each pair of notches 5*c* and 8*b*, and is fixed on the bottom surface of the gap 2 by bolts 15.

Reference numerals 16 and 19 denote reference pins inserted in pin holes 14*a* of the reference pin base 14 and fixed by nuts 18. The distance between the reference pins 16 and 19 is set to be equal to the distance between the reference pin holes 26 and 27 formed in the plate 13. The reference pins 16 and 19 are engaged with the corresponding reference pin holes 26 and 27 of the plate 13 inserted between the gripper surfaces 5*b* and 8*a*.

In the apparatus according to this embodiment, as shown in FIG. 2, the reference pin 16 comprises a conductive portion 16*a*, the central rectangular portion of which has two ends exposed to the circumferential surface and consists of a conductive material. Insulating portions 16*b* consisting of a nonconductive material such as ceramic are formed at two arcuated portions comprising two side portions of the conductive portion 16*a* such that the reference pin 16 contacts only a bottom portion 26*a* comprising an arcuated bottom surface defining the opening of the reference pin hole 26. In contrast, the reference pin 19 entirely consists of a conductive material, and part of its cylindrical circumferential surface is formed flat so as to be brought into surface contact with a bottom portion 27*a* of the reference pin hole 27.

In this plate mounting apparatus, as shown in FIG. 1, wires 21 and 22 connected to a power supply 20 are connected to the two reference pins 16 and 19 serving as the detecting portions, and the reference pins 16 and 19 are rendered conductive by an insertion end 13*a* of the conductive plate 13 inserted between the gripper surfaces 5*b* and 8*a*. More specifically, when the bottom portion 26*a* of the reference pin hole 26 of the plate 13 contacts and is electrically connected to the conductive portion 16*a* of the reference pin 16, and the bottom portion 27*a* of the reference pin hole 27 contacts and is electrically connected to the conductive reference pin 19, the two reference pins 16 and 19 serving as the detecting portions are rendered conductive through the plate 13. A lamp 23 serving as an indicator is arranged on the stationary portion of the machine frame. The lamp 23 is turned on when the two reference pins 16 and 19 are rendered conductive through the insertion end 13*a* of the plate 13.

Since the contact surface of the reference pin 16 is the insulating portion 16*b*, the reference pin 16 does not electrically contact the reference pin hole 26 even when the reference pin 16 contacts the engaging surface of the reference pin hole 26 while the reference pin 16 is being engaged with the reference pin hole 26. Therefore, the two reference pins 16 and 19 are not rendered conductive.

In this embodiment, as a means for disconnecting the circuit between the detecting portions and the indicator, contacts 24 and 25 are provided to the plate cylinder 1, and a contact roller (not shown), which is brought into contact with the contacts 24 and 25 by swingable movement of an arm, is provided to the machine frame, as shown in FIG. 3. The contact roller is brought into contact with the contacts 24 and 25 by swingable movement of the arm when the plate cylinder 1 is at rest to mount the plate 13 such that the circuit between the detecting portions and the indicator is formed.

The operation of the plate mounting apparatus having the above-described arrangement will be described. To mount the plate 13 on the plate cylinder 1, a wrench is engaged with the projecting portion 11*c* of the cam shaft 11 to turn the cam shaft 11, to cause the linear portions 11*a* of the cams to contact the plate 10. Thus, the gripper plates 8 are swung by the spring force of the spring member to open the gripper surfaces 5*b* and 8*a*. The operator holds the leading end of the plate 13 and inserts it between the gripper surfaces 5*b* and 8*a* while engaging the reference pin holes 26 and 27 with the reference pins 16 and 19, respectively.

When the bottom portion 26*a* of the reference pin hole 26 formed at the insertion end 13*a* of the plate 13 contacts the conductive portion 16*a* of the reference pin 16, and the bottom portion 27*a* of the reference pin hole 27 contacts the reference pin 19, the two reference pins 16 and 19 serving as the detecting portions of the plate cylinder 1 are rendered conductive by the conductive plate 13. At this time, even when the reference pin 16 contacts the engaging surface of the reference pin hole 26 while the reference pin 16 is being engaged with the reference pin hole 26, the two reference pins 16 and 19 are not rendered conductive during gripping operation of the plate 13 because the contact surface of the reference pin 16 is the insulating portion 16*b*. Therefore, an error to indicate completion of gripping operation is prevented while the plate is being gripped.

Thereafter, to check whether the insertion end 13*a* of the plate 13 is reliably inserted between the gripper surfaces 5*b* and 8*a*, the arm is swung by a drive apparatus to cause the contact roller (not shown) to be pressed against the contacts 24 and 25, connecting the contacts 24 and 25 to the power supply 20 and the indicator 23. At this time, if the insertion end 13*a* of the plate 13 is reliably inserted between the gripper surfaces 5*b* and 8*a*, the two reference pins 16 and 19 are rendered conductive to form the circuit of the lamp 23 and turn it on, as described above.

Thereafter, the cam shaft 11 is turned to cause the arcuated portions of the cams to contact the plate 10. Then, the gripper surfaces 5*b* and 8*a* are closed against the spring force of the spring member to grip one end of the plate 13. The plate cylinder 1 is rotated by almost one revolution to wind the plate 13 on the circumferential surface of the plate cylinder 1. The trailing-side plate lockup device is caused to grip the other end of the plate 13 in the same manner as described above, and the trailing-side plate lockup device is moved in the circumferential direction of the plate cylinder 1, so that the plate 13 is tightened and brought into tight contact with the circumferential surface of the plate cylinder 1, thus completing mounting of the plate 13. During mounting of the plate 13 as described above, the lamp 23 indicates that the plate 13 is reliably inserted between the gripper surfaces 5*b* and 8*a* of the leading-side plate lockup device 4. Therefore, the plate 13 can be reliably gripped.

In the above embodiment, the insulating portions 16*b* are provided only to the reference pin 16. However, insulating portions may also be provided to the reference pin 19. In this case, an indication error at the lamp 23 can completely be prevented, and the plate 13 can more reliably be inserted between the gripper surfaces 5*b* and 8*a*.

Figure 7:
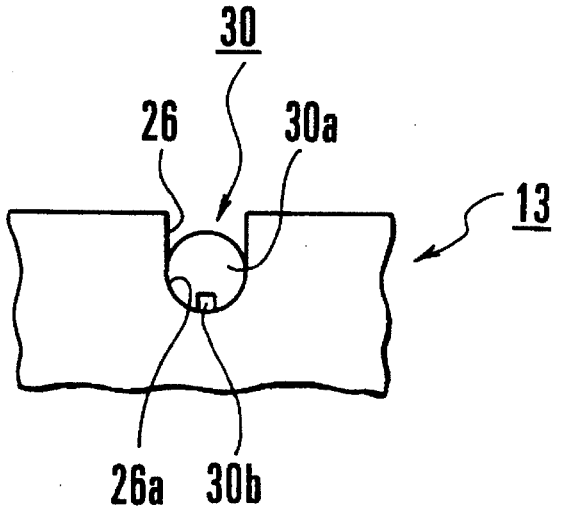
FIG. 7 is an enlarged plan view showing the main part of a plate mounting apparatus for a printing press according to another embodiment of the present invention.

FIG. 7 shows an engaging portion of a reference pin and a reference pin hole in a plate mounting apparatus for a printing press according to another embodiment of the present invention. Referring to FIG. 7, an engaging portion 30*a* of a reference pin 30 engaged with a reference pin hole 26 entirely consists of a nonconductive material such as ceramic. A metal piece 30*b* consisting of a conductive material such as a metal is buried in the circumferential surface of the engaging portion 30*a* at the position corresponding to a bottom portion 26*a* of the reference pin hole 26.

Thus, even if the reference pin 30 contacts the engaging surface of the reference pin hole 26 during engagement between the reference pin 30 and the reference pin 26, the reference pin 30 and the reference pin hole 26 are not rendered conductive because the reference pin 30 almost entirely consists of a nonconductive material.

Figure 8:
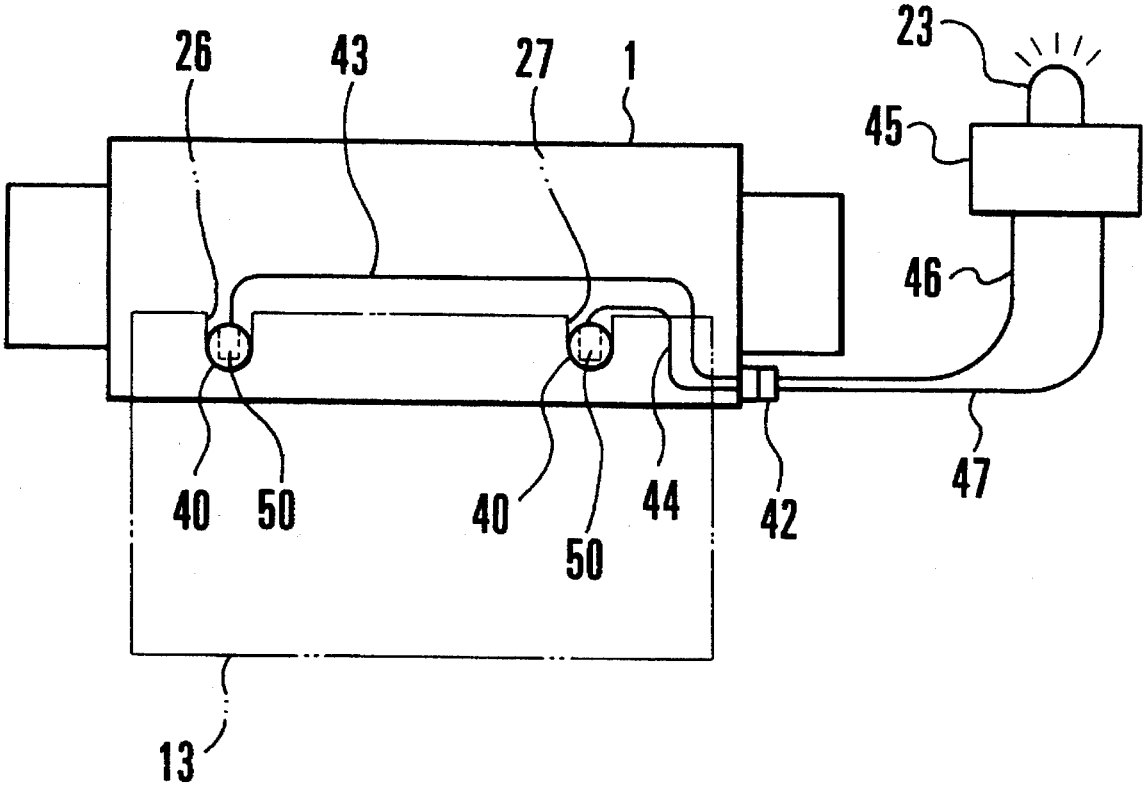
FIG. 8 is a schematic view showing the arrangement of a plate mounting apparatus for a printing press according to still another embodiment of the present invention.

FIG. 8 shows the schematic arrangement of a plate mounting apparatus for a printing press according to still another embodiment of the present invention. Referring to FIG. 8, instead of the reference pins 16 and 19 in the embodiment shown in FIGS. 1 to 6, a pair of left and right reference pins 40 are provided to a leading-side plate lockup device disposed in the outer circumferential gap of a plate cylinder 1. These reference pins 40 comprise nonmagnetic metal detecting sensors (nonmagnetic metal proximity switches) 50 to detect a nonmagnetic metal such as aluminum provided at the positions corresponding to the bottom surfaces of reference pins 26 and 27 of a plate 13. The nonmagnetic metal detecting sensors 50 are arranged in the radial direction of the two reference pins 40 such that the detecting surfaces oppose the bottom surfaces of the reference pins 26 and 27. A commercially available nonmagnetic metal detecting sensor has a detection distance of 0 to 2.0 mm. The nonmagnetic metal detecting sensors 50 of the two reference pins 40 is connected through wires 43 and 44 to a coupler 42 provided to the end portion of the plate cylinder 1 to transfer a signal. The coupler 42 and an indicator unit 45 are connected through wires 46 and 47.

In the above arrangement of this embodiment, when the plate 13 is reliably inserted between the gripper surfaces of the plate lockup device, the bottom surfaces of the reference pin holes 26 and 27 of the plate 13 consisting of aluminum, i.e., nonmagnetic metal, contact the reference pins 40 to be located within the detection distance of the nonmagnetic metal detecting sensors 50. The nonmagnetic metal detecting sensors 50 detect the proximal states and send indication signals to the indicator unit 45 through the coupler 42. The indicator unit 45 inputs the detection signals from the nonmagnetic metal detecting sensors 50 and indicates at a lamp 23 that the plate 13 is reliably inserted between the gripper surfaces of the plate lockup device. Note that the nonmagnetic metal detecting sensors 50 of the two reference pins 40 detect the proximal states of the bottom surfaces of the reference pin holes 26 and 27 respectively and output the detection signals. For this reason, the indicator unit 45 has a known circuit to logically AND the two detection signals. Accordingly, the nonmagnetic metal detecting sensors 50 are adequate for the reference pins 40. Portions except for the nonmagnetic metal detecting sensors 50 need not be made of an insulating material.

In the embodiments described above, the contacts 24 and 25 and the contact roller are exemplified as a means for connecting the indicator of the machine frame and the detecting portion comprising the reference pins of the plate cylinder 1. However, the present invention is not limited to this. For example, a transmitting coupler may be provided to the plate cylinder 1 while a receiving coupler which does not contact the transmitting coupler may be provided to the machine frame, and electromagnetic or optical signal transfer may be performed between the transmitting coupler and the receiving coupler. Accordingly, although the lamp 23 is exemplified as an indicator in each embodiment, a buzzer may be operated instead of the lamp 23, or a buzzer may be provided together with the lamp 23.

In each embodiment, the reference pin hole 26 formed in the plate 13 has a U-shape to open at the leading end of the plate 13. However, the reference pin hole 26 is not necessarily open. It may be a closed elongated hole at the leading end of the plate 13. In this case, the reference pin of the plate lockup device has a shape enough to engage with the reference pin hole or retract from the reference pin hole.

In each embodiment, the vertical mounting state of the plate 13 is monitored by left and right pairs of the reference pins 26, 27, 30, and 40. However, another reference pin or another pair of reference pins to detect and monitor the horizontal mounting state of the plate 13 by electrical contact may be added.

As has been described above, according to the present invention, during the mounting operation of the plate on the plate cylinder, the operator can confirm by the indicator that the plate is completely inserted between the plate gripper surfaces of the plate lockup device. Plate mounting becomes reliable as compared to conventional insertion determination which is done according to the sense of the operator. Variations caused by the degrees of skills of the operators are eliminated, thereby improving the quality of the printed matter. A plate mounting operation can also be easily performed, and the efficiency is improved.

Furthermore, since the reference pins and the reference pin holes are not rendered conductive while the reference pins and the reference pin holes are being engaged, an indication error can be prevented until the plate is completely inserted. Therefore, accuracy in mounting the plate can be improved.

What is claimed is:

1. An apparatus for mounting a plate on a plate cylinder, comprising:

a plate lockup device provided in a gap formed in a circumferential surface of said plate cylinder;

a reference pin supported by a gripper portion of said plate lockup device and engaged with a reference pin hole formed at an insertion end of a plate when said plate is inserted into said gripper portion of said plate lockup device;

plate detecting means, arranged in the reference pin to oppose only a bottom portion of said reference pin hole, for electrically detecting that said bottom portion of said reference pin hole contacts said reference pin, and does not detect the plate insertion even when the side portion of the reference pin hole contacts said reference pin; and indicator means for confirming and indicating insertion of the plate on the basis of an output from said plate detecting means.

2. An apparatus for mounting a plate on a plate cylinders, comprising:

a plate lockup device provided in a gap formed in a circumferential surface of said plate cylinder;

a reference pin supported by a gripper portion of said plate lockup device and engaged with a reference pin hole formed at an insertion end of a plate when said plate is inserted into said gripper portion of said plate lockup device:

plate detecting means, arranged in the reference pin to oppose only a bottom portion of said reference pin hole, for electrically detecting that said bottom portion of said reference pin hole contacts said reference pin, and does not detect the plate insertion even when the side portion of the reference pin hole contacts said reference pin;

indicator means for confirming and indicating insertion of the plate on the basis of an output from said plate detecting means;

wherein said reference pin comprises a conductive portion exposed at the position corresponding to said bottom portion of said reference pin hole to constitute said plate detecting means, and an insulating portion for insulating said reference pin hole except for said bottom portion thereof, said conductive portion electrically contacting said reference pin hole formed in a conductive plate to detect insertion of the plate.

3. An apparatus for mounting a plate on a plate cylinder, comprising:

a plate lockup device provided in a gap formed in a circumferential surface of said plate cylinder;

a reference pin supported by a gripper portion of said plate lockup device and engaged with a reference pin hole formed at an insertion end of a plate when said plate is inserted into said gripper portion of said plate lockup device;

plate detecting means, arranged in the reference pin to oppose only a bottom portion of said reference pin hole, for electrically detecting that said bottom portion of said reference pin hole contacts said reference pin, and does not detect the plate insertion even when the side portion of the reference pin hole contacts said reference pin;

indicator means for confirming and indicating insertion of the plate on the basis of an output from said plate detecting means;

wherein said reference pin comprises a nonconductive material and has a conductive metal piece constituting said plate detecting means at the position corresponding to said bottom portion of said reference pin hole, said conductive metal piece electrically contacting said reference pin hole formed in a conductive plate to detect insertion of the plate.

4. An apparatus for mounting a plate on a plate cylinder, comprising;

a plate lockup device provided in a gap formed in a circumferential surface of said plate cylinder;

a reference pin supported by a gripper portion of said plate lockup device and engaged with a reference pin hole formed at an insertion end of a plate when said plate is inserted into said gripper portion of said plate lockup device;

plate detecting means, arranged in the reference pin to oppose only a bottom portion of said reference pin hole, for electrically detecting that said bottom portion of said reference pin hole contacts said reference pin, and does not detect the plate insertion even when the side portion of the reference pin hole contacts said reference pin;

indicator means for confirming and indicating insertion of the plate on the basis of an output from said plate detecting means;

wherein said reference pin has a nonmagnetic metal detecting sensor constituting said plate detecting means at the position corresponding to said bottom portion of said reference pin hole, said nonmagnetic metal detecting sensor detecting a proximal state of said bottom portion of said reference pin hole formed in a nonmagnetic metal plate to detect insertion of the plate.

5. An apparatus for mounting a plate on a plate cylinder, comprising:

a plate lockup device provided in a gap formed in a circumferential surface of said plate cylinder;

a reference pin supported by a gripper portion of said plate lockup device and engaged with a reference pin hole formed at an insertion end of a plate when said plate is inserted into said gripper portion of said plate lockup device;

plate detecting means, arranged in the reference pin to oppose only a bottom portion of said reference pin hole, for electrically detecting that said bottom portion of said reference pin hole contacts said reference pin, and does not detect the plate insertion even when the side portion of the reference pin hole contacts said reference pin;

indicator means for confirming and indicating insertion of the plate on the basis of an output from said plate detecting means;

further comprising a conductive reference pin supported by said gripper portion of said plate lockup device and engaged with another reference pin hole formed at an insertion end of said plate to electrically contact with each other when said plate is inserted into said gripper portion of said plate lockup device, and wherein said plate detecting means and said conductive reference pin are rendered conductive through said conductive plate, thereby detecting insertion of the plate.

6. An apparatus for mounting a plate on a plate cylinder, comprising;

a plate lockup device provided in a gap formed in a circumferential surface of said plate cylinder;

a reference pin supported by a gripper portion of said plate lockup device and engaged with a reference pin hole formed at an insertion end of a plate when said plate is inserted into said gripper portion of said plate lockup device;

plate detecting means, arranged in the reference pin to oppose only a bottom portion of said reference pin hole, for electrically detecting that said bottom portion of said reference pin hole contacts said reference pin, and does not detect the plate insertion even when the side portion of the reference pin hole contacts said reference pin;

indicator means for confirming and indicating insertion of the plate on the basis of an output from said plate detecting means;

wherein said reference pin comprises a pair of reference pins, said reference pin hole comprises a pair of reference pin holes engaged with said pair of reference pins, and said plate detecting means arranged in each of said pair of reference pins is rendered conductive through a conductive plate, thereby detecting insertion of the plate.

* * * * *